US011819725B2

(12) United States Patent
Kabasso

(10) Patent No.: US 11,819,725 B2
(45) Date of Patent: Nov. 21, 2023

(54) BED EXERCISE APPARATUS

(71) Applicant: David Kabasso, Brooklyn, NY (US)

(72) Inventor: David Kabasso, Brooklyn, NY (US)

( * ) Notice: Subject to any disclaimer, the term of this patent is extended or adjusted under 35 U.S.C. 154(b) by 384 days.

(21) Appl. No.: 17/040,690

(22) PCT Filed: Mar. 26, 2019

(86) PCT No.: PCT/US2019/024031

§ 371 (c)(1),
(2) Date: Sep. 23, 2020

(87) PCT Pub. No.: WO2019/191066

PCT Pub. Date: Oct. 3, 2019

(65) Prior Publication Data

US 2021/0046349 A1 Feb. 18, 2021

Related U.S. Application Data

(60) Provisional application No. 62/647,935, filed on Mar. 26, 2018.

(51) Int. Cl.

| | |
|---|---|
| ***A63B 21/04*** | (2006.01) |
| ***A63B 21/00*** | (2006.01) |
| ***A63B 21/055*** | (2006.01) |

(52) U.S. Cl.

CPC ..... *A63B 21/0442* (2013.01); *A63B 21/0557* (2013.01); *A63B 21/4027* (2015.10); *A63B 2209/00* (2013.01); *A63B 2210/04* (2013.01)

(58) Field of Classification Search

CPC ..... A63B 21/0442; A63B 2209/00; A63B 2210/04

See application file for complete search history.

(56) References Cited

U.S. PATENT DOCUMENTS

| | | | |
|---|---|---|---|
| 588,622 | A | 8/1897 | Ware |
| 1,095,397 | A | 5/1914 | Hillyer |
| 1,240,809 | A | 9/1917 | Baldwin |
| 1,561,979 | A | 11/1925 | Gore |
| 2,057,811 | A | 10/1936 | Armstrong |
| 2,245,331 | A | 6/1941 | Dawley |
| 2,701,374 | A | 2/1955 | Hillenbrand |
| 2,724,127 | A | 11/1955 | Trivas |
| 2,844,829 | A | 7/1958 | Levy |
| 3,077,613 | A | 2/1963 | Mayer |
| 3,134,592 | A | 5/1964 | Sharkey |
| 3,218,067 | A | 11/1965 | Beverly |

(Continued)

FOREIGN PATENT DOCUMENTS

| | | | |
|---|---|---|---|
| CH | 675971 | A5 | 11/1990 |
| CN | 2527310 | Y | 12/2002 |

(Continued)

*Primary Examiner* — Joshua T Kennedy

(74) *Attorney, Agent, or Firm* — Law Office of M Zev Lvoritz; Menachem Zev Levoritz

(57) ABSTRACT

An exercise apparatus for use with a bed. The exercise apparatus may be configured with a base and a rod. The base is held in place by a leg of the headboard or a leg of the bed frame. The rod connects to the base and the rod extends through a space between the mattress and the headboard above a top surface of the mattress. At the top of the rod an elastic exercise band or other exercise accessory may be attached.

8 Claims, 13 Drawing Sheets

(56) References Cited

U.S. PATENT DOCUMENTS

| | | | | |
|---|---|---|---|---|
| 3,351,960 | A | 11/1967 | Burkholder | |
| 3,523,310 | A | 8/1970 | Shead | |
| 3,540,435 | A | 11/1970 | Smith | |
| 3,699,953 | A | 10/1972 | Masson | |
| 3,826,490 | A * | 7/1974 | Mossman | A63B 21/16 482/904 |
| 3,887,180 | A | 6/1975 | Berman | |
| 4,550,907 | A * | 11/1985 | Melillo | A63B 23/0216 482/140 |
| 4,591,121 | A | 5/1986 | Doyle | |
| 4,611,804 | A | 9/1986 | Addair | |
| 4,635,931 | A | 1/1987 | Brännstan | |
| 4,671,257 | A | 6/1987 | Kaiser et al. | |
| 4,672,697 | A | 6/1987 | Schürch | |
| 4,674,485 | A | 6/1987 | Swanson | |
| 4,717,148 | A | 1/1988 | Brewer | |
| 4,829,610 | A | 5/1989 | Gonzalez-Alvarez et al. | |
| 4,905,330 | A | 3/1990 | Jacobs | |
| 4,925,184 | A | 5/1990 | McJunkin, Jr. et al. | |
| 5,005,829 | A | 4/1991 | Caruso | |
| 5,070,555 | A | 12/1991 | Pearson et al. | |
| 5,121,516 | A | 6/1992 | Jones | |
| 5,160,306 | A | 11/1992 | Lui | |
| 5,181,289 | A | 1/1993 | Kassai | |
| 5,207,628 | A | 5/1993 | Graham | |
| 5,375,280 | A | 12/1994 | O'Sullivan et al. | |
| 5,407,411 | A | 4/1995 | Trainor | |
| 5,743,050 | A | 4/1998 | Shibata | |
| 5,820,519 | A * | 10/1998 | Slenker | A63B 21/4015 601/24 |
| 5,820,532 | A | 10/1998 | Oliver | |
| 5,989,168 | A | 11/1999 | See | |
| 6,152,855 | A | 11/2000 | Dean, Jr. et al. | |
| 6,228,004 | B1 * | 5/2001 | Steinbach | A63B 21/16 482/904 |
| 6,241,642 | B1 | 6/2001 | Slenker | |
| 6,416,447 | B1 | 7/2002 | Harmon | |
| 6,685,605 | B1 | 2/2004 | Klossner | |
| 7,229,392 | B2 | 6/2007 | Turnbull et al. | |
| 9,586,077 | B2 | 3/2017 | Kabasso | |
| 10,166,432 | B2 | 1/2019 | Kabasso | |
| 10,780,312 | B2 | 9/2020 | Kabasso | |
| 2003/0224915 | A1 | 12/2003 | Charoenchit | |
| 2004/0002410 | A1 | 1/2004 | Steinbach et al. | |
| 2004/0157708 | A1 | 8/2004 | Matthews | |
| 2005/0130814 | A1 * | 6/2005 | Nitta | A63B 1/00 482/121 |
| 2005/0272566 | A1 | 12/2005 | Otsuka | |
| 2007/0203434 | A1 | 8/2007 | Namgung et al. | |
| 2008/0254954 | A1 | 10/2008 | Kim | |
| 2010/0331152 | A1 * | 12/2010 | Pedrera | A63B 21/16 482/129 |
| 2011/0237407 | A1 | 9/2011 | Kaleal | |
| 2014/0200125 | A1 * | 7/2014 | Kabasso | A47C 21/003 482/142 |
| 2016/0206912 | A1 | 7/2016 | Carriere, Jr. | |

FOREIGN PATENT DOCUMENTS

| | | | |
|---|---|---|---|
| DE | 2145884 | A1 | 3/1973 |
| EP | 0514368 | A1 | 12/1999 |
| JP | 11276306 | A | 12/1999 |
| JP | 2002065892 | A | 3/2002 |
| JP | 2007296224 | A | 11/2007 |
| KR | 100346528 | B1 | 7/2002 |

* cited by examiner

BED EXERCISE APPARATUS

TECHNICAL FIELD

The invention disclosed herein generally relates to an exercise apparatus. In particular, the inventive exercise apparatus is for exercising in a bed primarily for stretching and resistance exercises.

DISCLOSURE OF INVENTION

The present invention provides an exercise apparatus that may be used in a bed and be easily configured for many different exercises, primarily stretching and resistance exercises, while minimizing stress on the bed structure and in some embodiments may be dismantled and/or hidden from view with relative ease.

MODES FOR CARRYING OUT THE INVENTION

Figure 1:
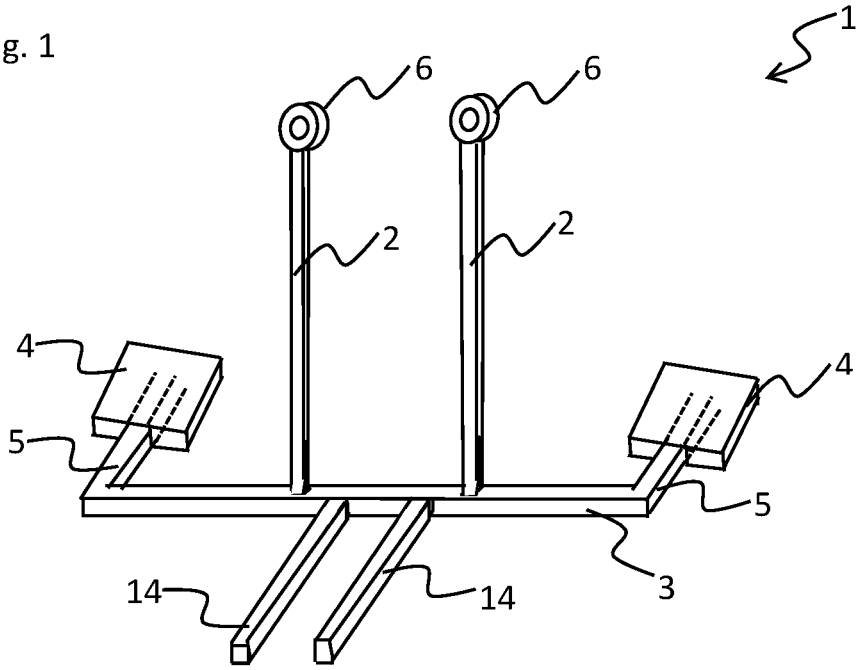
FIG. 1 is a perspective view of a first exemplary embodiment of a bed exercise apparatus according to the present invention.
Figure 2:
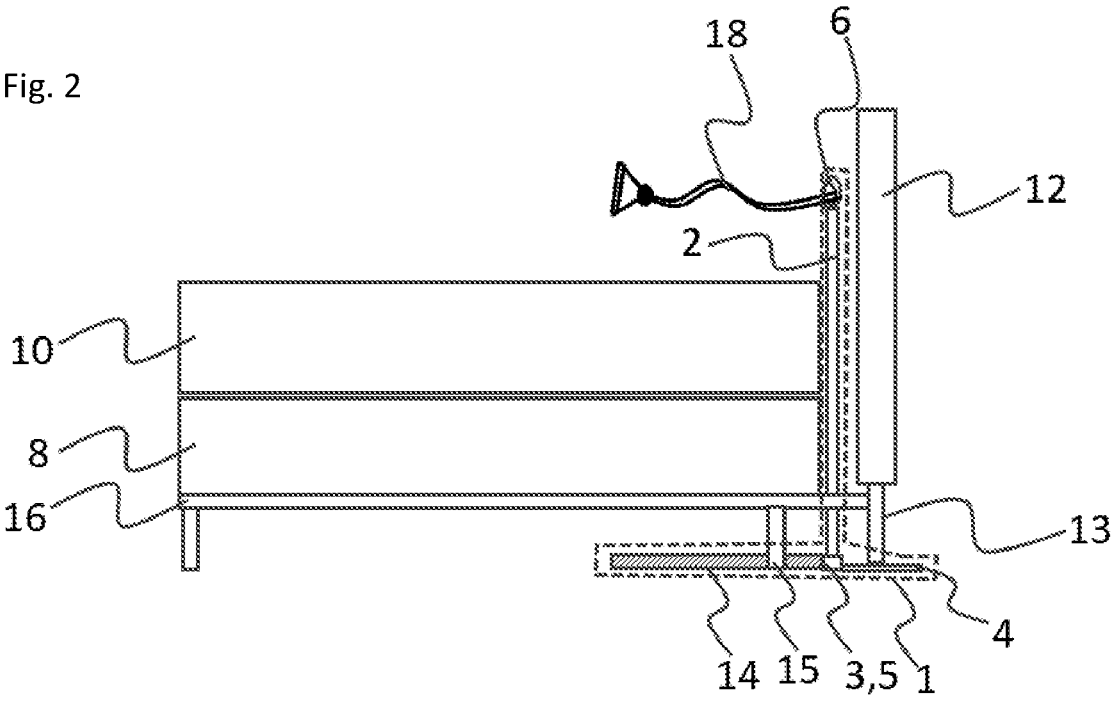
FIG. 2 is a side view of the first exemplary embodiment of the bed exercise apparatus with a headboard, bed frame, box spring and mattress according to the present invention.

FIGS. 1 and 2 illustrate a first exemplary embodiment of a bed exercise apparatus 1 according to the present invention. FIG. 1 shows a perspective view of the bed exercise apparatus 1 with rods 2 connected to a base 3. FIG. 2 is a side view of the bed exercise apparatus 1 in an exemplary arrangement of the bed exercise apparatus 1 with a headboard 12, mattress frame 16, box spring 8 and mattress 10. As shown in FIG. 2, the rods 2 extend in a vertical direction through a gap where the headboard 12 attaches to the mattress frame 16. Similarly, in all subsequent exemplary embodiments, rods or analogous structure extend through a gap where a headboard attaches to a mattress frame. The rods 2 are preferably configured, as shown, to extend above a height of the mattress 10. At a top of the rods 2 are rings 6 for attachment of elastic exercise bands 18 and other exercise accessories. Other attachment configurations other than the rings 6 may be implemented for attachment of exercise accessories. The rods 2 may be configured with a telescoping structure so that their height may be adjusted and possibly to allow for the rods 2 to retract below the height of the mattress 10 so that they are in a recessed position. The rods 2 may also be removably and/or rotatably attached to the base 3. The rods 2 may also be movably attached to the base 3 to allow for adjustment of the position of the rods 2 in one or both of a widthwise and a lengthwise direction with respect to the base 3. The base 3 extends in the widthwise direction between base ends 5 and then extends in the lengthwise direction toward the headboard 12, as shown in FIG. 2, terminating with pads 4.

The base 3 extends in both the widthwise and lengthwise directions a sufficient amount to allow feet 13 of the headboard 12 to rest upon the pads 4. In an alternative configuration of the bed exercise apparatus 1, the base 3 may extend at angles to the widthwise and the lengthwise directions rather than distinctly in the widthwise or the lengthwise direction, as shown in FIG. 1, or may extend as a combination of extensions in the widthwise or the lengthwise direction or angles thereof. Alternatively, the base 3 may extend without the pads 4 and the feet 13 of the headboard 12 rest upon the base 3. In another alternative configuration, the base 3 is slidably engaged with the pads 4 so as to provide the capability of adjustment in the lengthwise direction. The base 3 may, alternatively, be configured to allow feet 15 of the mattress frame 16 to rest upon the pads 4 or directly upon the base 3.

From the base 3, extending in the lengthwise direction toward the mattress frame 16, as shown in FIG. 2, are two projections 14. Alternatively, the base 3 tray have one projection 14, three or more projections 14 or none at all. In another alternative embodiment, the projections 14 may extend from the base 3 at an angle to the lengthwise direction.

The bed exercise apparatus 1 and all the exemplary embodiments described herein, may be constructed of parts formed of hollow steel tubing, in which the hollow steel tubing has a rectangular cross-sectional form. Alternatively, instead of hollow steel tubing the bed exercise apparatus 1 and other embodiments of the invention may be constructed of solid steel and/or may have other cross-sectional forms. Furthermore, the bed exercise apparatus 1 and other embodiments of the invention may be constructed of other materials such as wood, plastic, fiberglass, aluminum or other metals or any other material that can bear the load that will be placed upon them. The various parts of the bed exercise apparatus 1 and other embodiments that are fixedly attached to each other may be affixed by welding, gluing, via threading or any other manner known in the art.

Figure 3:
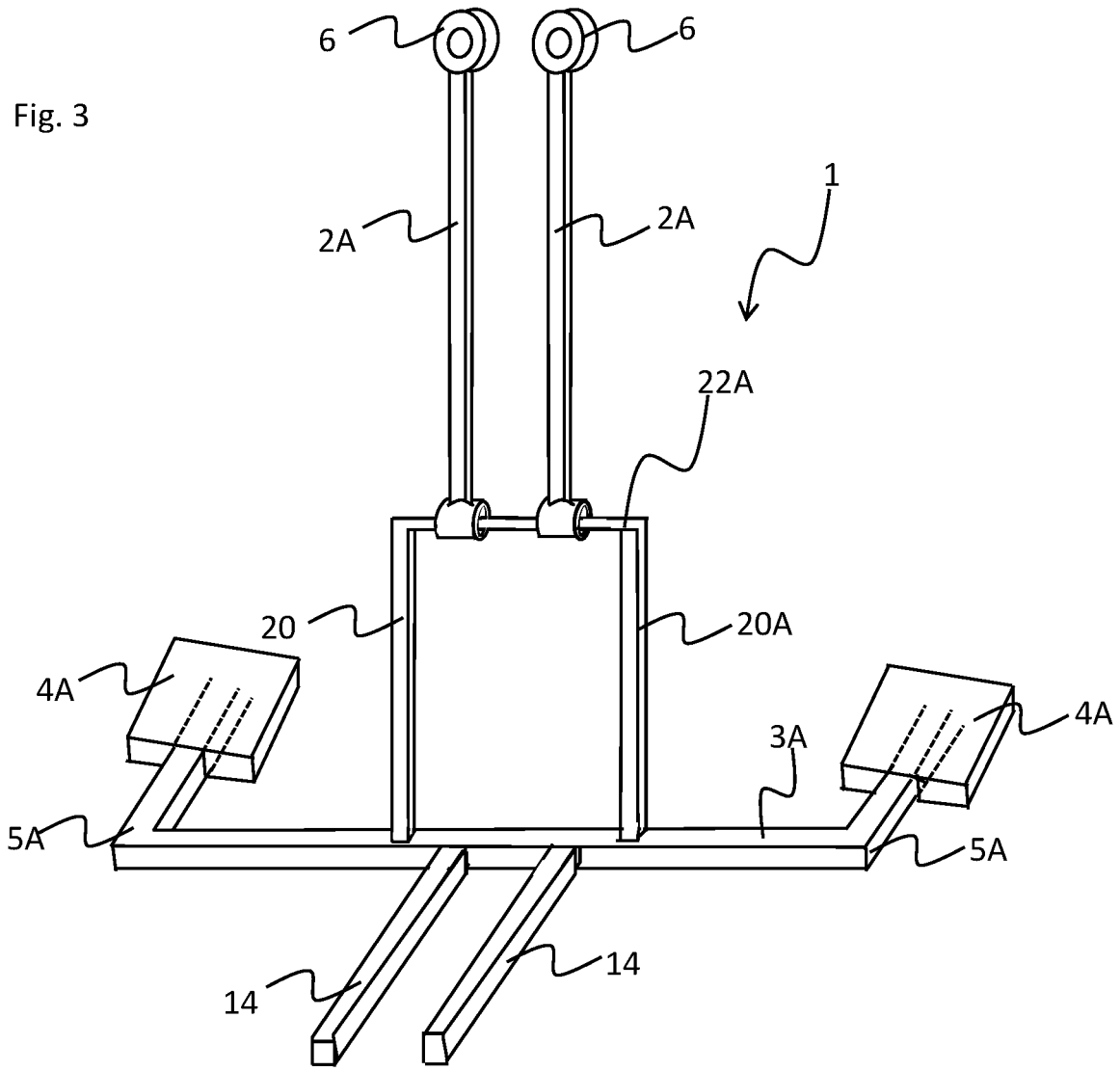
FIG. 3 is a perspective view of a second exemplary embodiment of the bed exercise apparatus according to the present invention.
Figure 4:
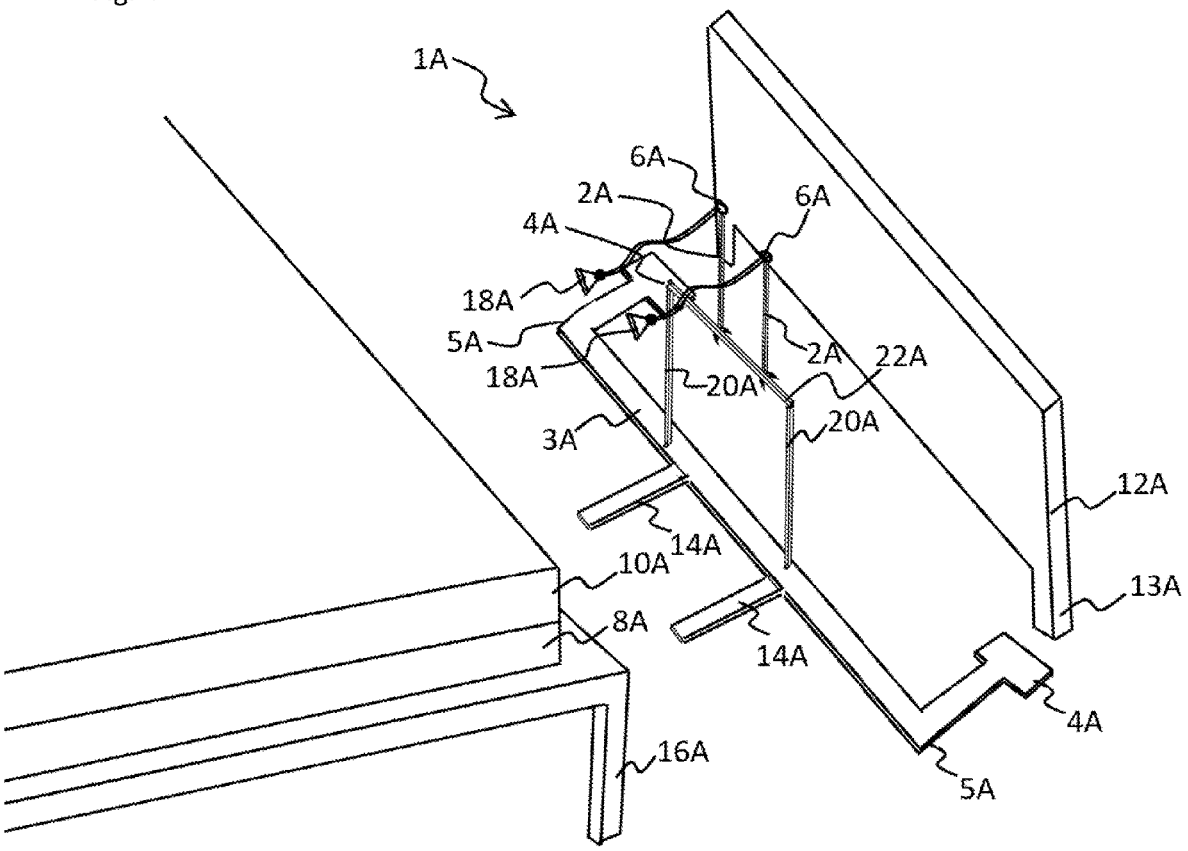
FIG. 4 is a perspective view of the second exemplary embodiment of the bed exercise apparatus in a quasi-exploded view with respect to a headboard and a bed frame with a box spring and mattress according to the present invention.

FIGS. 3 and 4 show a second exemplary embodiment of a bed exercise apparatus 1A according to the present invention. FIG. 3 shows a perspective view of the bed exercise apparatus 1A with rods 2A connected to a horizontal support 22A. The horizontal support 22A extends between upper ends of vertical supports 20A that extend from base 3A. Alternatively, only one vertical support 20A may be provided. In such a configuration, the vertical support 20A may preferably connect to the horizontal support 22A at a point closer to the center of the horizontal support 22A.

FIG. 4 is a perspective view of the bed exercise apparatus 1A in a quasi-exploded view of an exemplary arrangement of the bed exercise apparatus 1A with a headboard 12A, mattress frame 16A, box spring 8A and mattress 10A. The vertical supports 20A and rods 2A extend through a gap where the headboard 12A attaches to the mattress frame 16A. The vertical supports 20A are preferably configured to extend below the height of the mattress 10A and the rods 2A are preferably configured to extend from the horizontal support 22A to above a height of the mattress 10A. At a top of the rods 2A are rings 6A for attachment of elastic exercise bands 18A and other exercise accessories. Other attachment configurations other than the rings 6A may be implemented for attachment of exercise accessories.

The rods 2A may be configured with a telescoping structure so that their height may be adjusted and possibly to allow for the rods 2A to retract below the height of the mattress 10A so that they are in a recessed position. Alternatively, the rods 2A may attach to the horizontal support 22A through apertures in the horizontal support 22A. The apertures in the horizontal support 22A may be configured with an asymmetrical shape the rods 2A being configured with protrusions at various heights so as to allow vertical adjustment only when protrusions on the rods 2A are aligned with an aperture in the horizontal support 22A. Alternatively, the apertures in the horizontal support 22A may be threaded on their inner surface. The rods 2A would have threads along an extended portion of their outer surface that are configured to mate with the aperture thread and, thereby, allow for height adjustment by rotating the rods 2A.

Alternatively, the rods 2A may be removably and/or rotatably attached, via a hinge structure, to the horizontal support 22A. Additionally, the horizontal support 22A may be removably attached to the one or more vertical supports 20A and/or the vertical supports 20A may be removably attached to the base 3A. The vertical supports 20A may be configured with a telescoping structure so that the height of the vertical supports 20A may be adjusted and thereby provide adjustment in the height of the rods 2A. Additionally, horizontal support 22A may be slidably attached to the one or more vertical supports 20A to allow for height adjustment of the rods 2A.

In the bed exercise apparatus 1A, the rods 2A, as illustrated, are movably attached to the horizontal support 22A to allow for adjustment of the position of the rods 2 in a "widthwise" direction with respect to the base 3A. Additionally, the rods 2A may be movably attached to the horizontal support 22A to allow for adjustment of the position of the rods 2A in a "lengthwise" direction, i.e. toward the mattress 10A or toward the headboard 12A. The base 3A extends in the widthwise direction between base ends 5A and then extends in the lengthwise direction toward a headboard 12A, as shown in FIG. 4, terminating with pads 4A.

The base 3A extends in both the widthwise and the lengthwise directions a sufficient amount to allow feet 13A of the headboard 12A to rest upon the pads 4A. In an alternative configuration of the bed exercise apparatus 1A, the base 3A may extend at angles to the widthwise and the lengthwise directions rather than distinctly in the widthwise or the lengthwise direction, as shown in FIG. 1A, or may extend as a combination of extensions in the widthwise or the lengthwise direction or angles thereof. In another alternative configuration, the base 3A may extend without the pads 4A and the feet 13A rest upon the base 3A. In another alternative configuration, the base 3A is slidably engaged with the pads 4A so as to provide the capability of adjustment in the lengthwise direction.

From the base 3A, extending in the lengthwise direction toward the mattress frame 16A, as shown in FIG. 2A, are two projections 14A. The variations discussed above by projections 14 apply to projections 14A as well.

Figure 5:
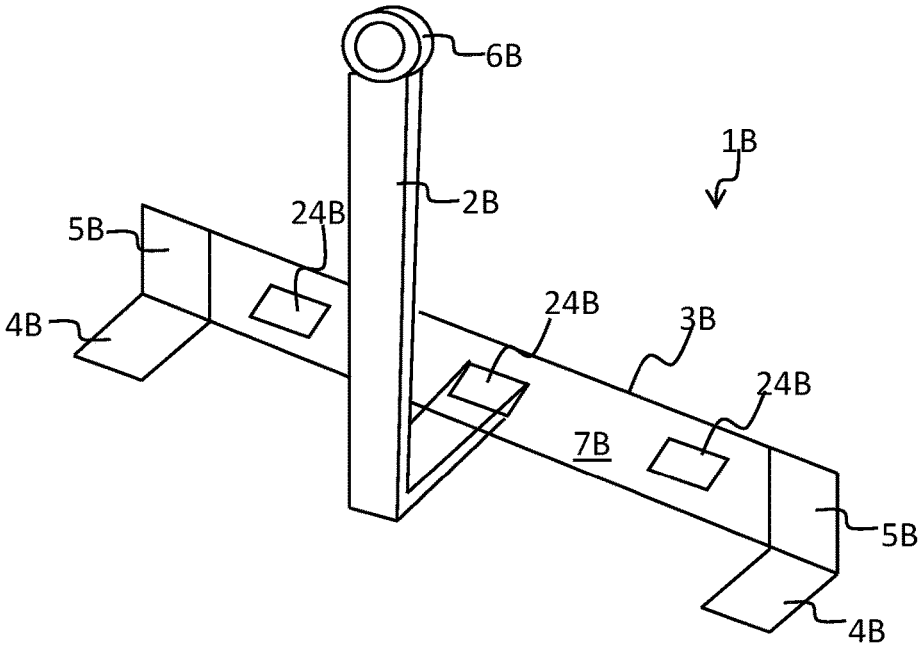
FIG. 5 is a perspective view of a third exemplary embodiment of the bed exercise apparatus according to the present invention.
Figure 6:
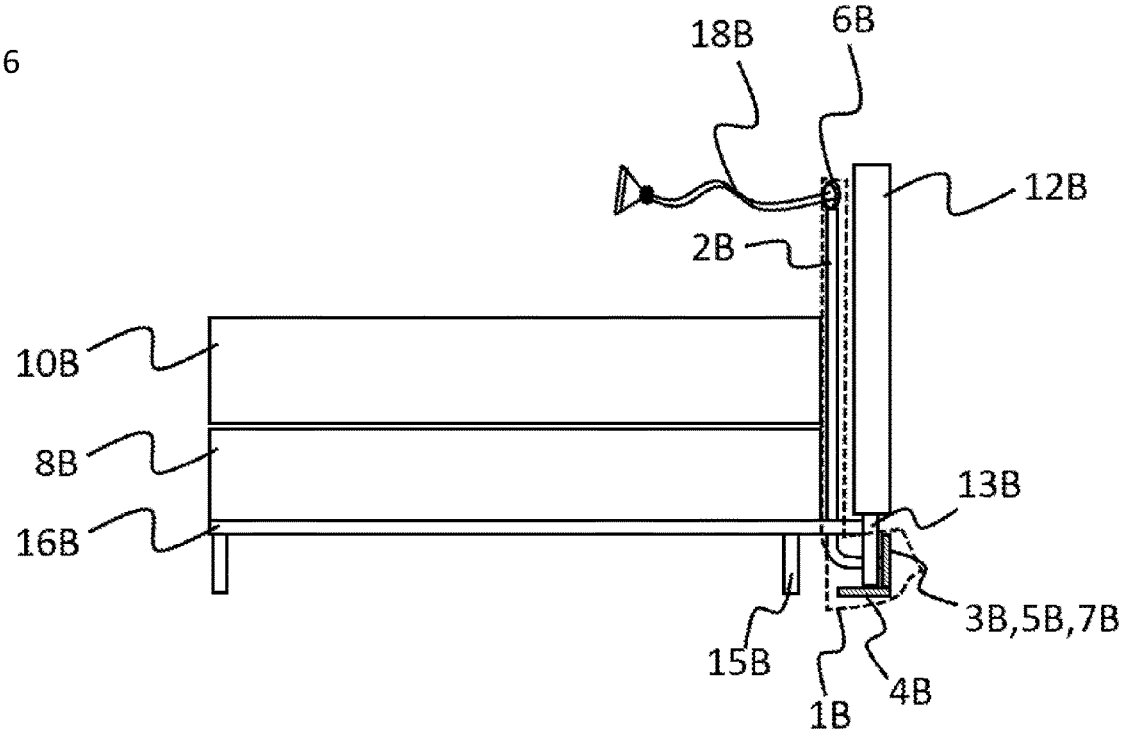
FIG. 6 is a side view of the third exemplary embodiment of the bed exercise apparatus with a headboard, bed frame, box spring and mattress according to the present invention.

FIGS. 5 and 6 show a third exemplary embodiment of a bed exercise apparatus 1B according to the present invention. FIG. 5 shows a perspective view of the bed exercise apparatus 1B with a rod 2B connected to a base 3B through one of the apertures 24B on a vertical base portion 7B. FIG. 6 is a side view of the bed exercise apparatus 1B in an exemplary arrangement of the bed exercise apparatus 1B with a headboard 12B, mattress frame 16B, box spring 8B and mattress 10B.

The vertical base portion 7B extends in a widthwise direction between base ends 5B. The base 3B may have one or multiple apertures 24B, as in the exemplary embodiment bed exercise apparatus 1B, to allow for adjustment of the position of the rod 2B in the widthwise direction or to allow for multiple rods 2B to be connected to the base 3B at the same time.

At the base ends 5B are pads 4B that extend in a lengthwise direction toward the headboard 12B, as shown in FIG. 6, to allow feet 13B of the headboard 12B to rest upon the pads 4B. In the exemplary arrangement shown in FIG. 6, the headboard 12B is between the vertical base portion 7B and the mattress frame 16B. Alternatively, the vertical base portion 7B may be between the headboard 12B and the mattress frame 16B and the pads 4B extend lengthwise in the other direction, relative to the base portion 7B, to allow feet 13B of the headboard 12B to rest upon the pads 4B. Alternatively, the vertical base portion 7B may be between the headboard 12B and the mattress frame 16B and the pads 4B extend lengthwise toward the mattress frame 16B to allow feet 15B of the mattress frame 12B to rest upon the pads 4B.

In the bed exercise apparatus 1B, the pads 4B are an integrated part of the base 3B. In an alternative configuration, the pads 4B may be slidably engaged with the base 3B to provide the capability of adjustment in the lengthwise direction. In another alternative configuration of the bed exercise apparatus 1B, the base 3B may extend at angles to the widthwise and the lengthwise directions rather than distinctly in the widthwise or the lengthwise direction, as shown in FIG. 5, or may extend as a combination of extensions in the widthwise or the lengthwise direction or angles thereof.

The rod 2B extends from the base 3B in the lengthwise direction under the headboard 12B and between the feet 13B of the headboard 12B, and then angles up in a vertical direction between the headboard 12B and the mattress frame 16B to extend above a height of the mattress 10B. At a top of the rod 2B is a ring 6B for attachment of an elastic exercise band 18B and other exercise accessories. Other attachment configurations other than the ring 6B may be implemented for attachment of exercise accessories. The rod 2B may be configured with a telescoping structure so that its height may be adjusted and possibly to allow for the rod 2B to retract below the height of the mattress 10B into a recessed position. This telescoping structure of rod 2B may include a configuration where the parts of the rod 2B are connected to each other via extended helical threading to allow for variation in height by rotating one portion of the rod 2B with respect to another. Alternatively, the rod 2B may also be rotatable via a hinge where the rod 2B attaches to the base portion 7B or at some point along the length of the rod 2B. Additionally, the rod 2*b* may be removably attached to the base portion 7B or an upper portion of the rod 2B may be removably attached to a lower portion of the rod 2B, where the lower portion of the rod 2B is the part that attaches to the base portion 7B.

Figure 12:
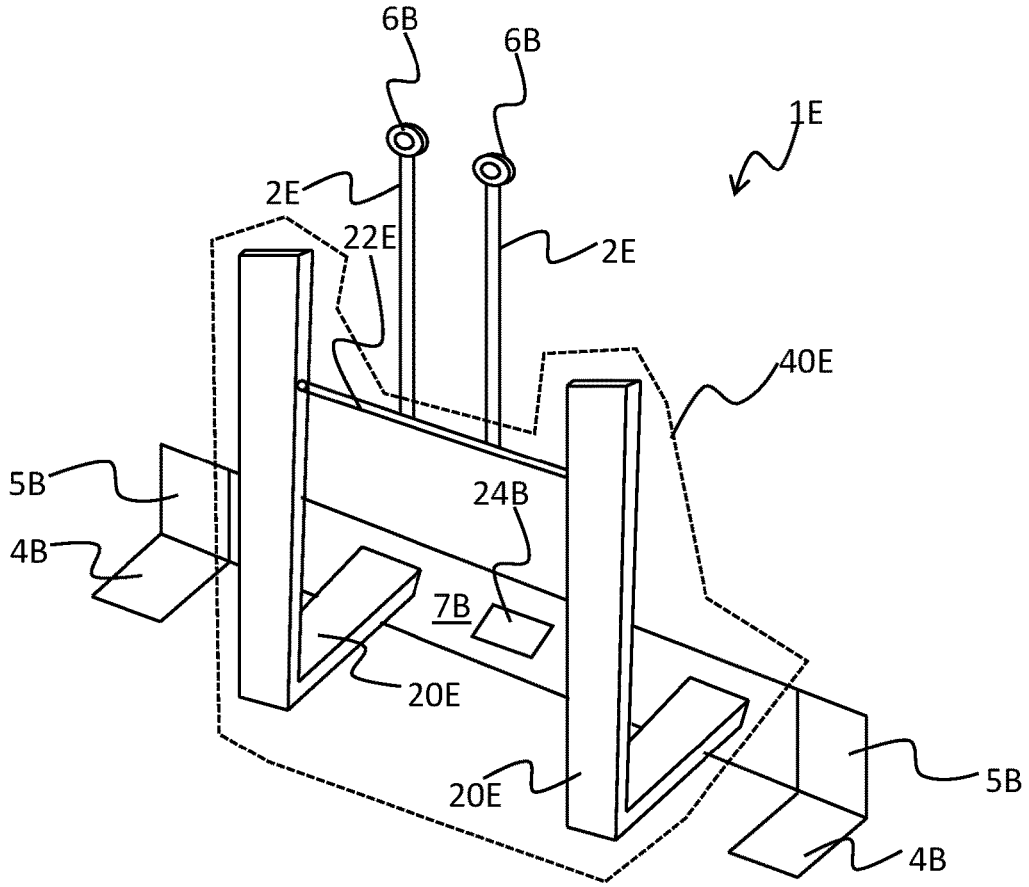
FIG. 12 is a perspective view of an alternative configuration of the third exemplary embodiment of the bed exercise apparatus according to the present invention.

FIG. 12 shows an exercise apparatus 1E that is an alternative configuration of the exercise apparatus 1B with a horizontal and vertical support structure 40E, comparable to the one disclosed above by the exercise apparatus 1A. Elements of exercise apparatus 1E that are not modified from the exemplary embodiment exercise apparatus 1B have the same element number designations. One or more vertical supports 20E connect to the base 3B, comparable to the vertical supports 20A except that the one or more vertical supports 20E angle upward in the manner that rod 2B does. All the alternative configurations of rod 2B discussed above regarding adjustment of height rod 2B or how rod 2B attaches to the base portion 7B apply to the vertical supports 20E. A horizontal support 22E, comparable to the horizontal support 22A, connects to an upper end or ends on the one or more vertical supports 20E. The horizontal support 22E may connect to the vertical supports 22E in any of the various ways described above by horizontal support 22A in exercise apparatus 1A. In the case of only one vertical support 20E, especially, but not exclusively, the vertical support 20E may connect to horizontal support 20E at a point proximal to a midpoint on the horizontal support 22E. One or more rods 2E are configured like the rod 2A and may connect to the horizontal support 22E in the ways described above by rod 2A connecting to horizontal support 22A in exercise apparatus 1A.

Figure 13:
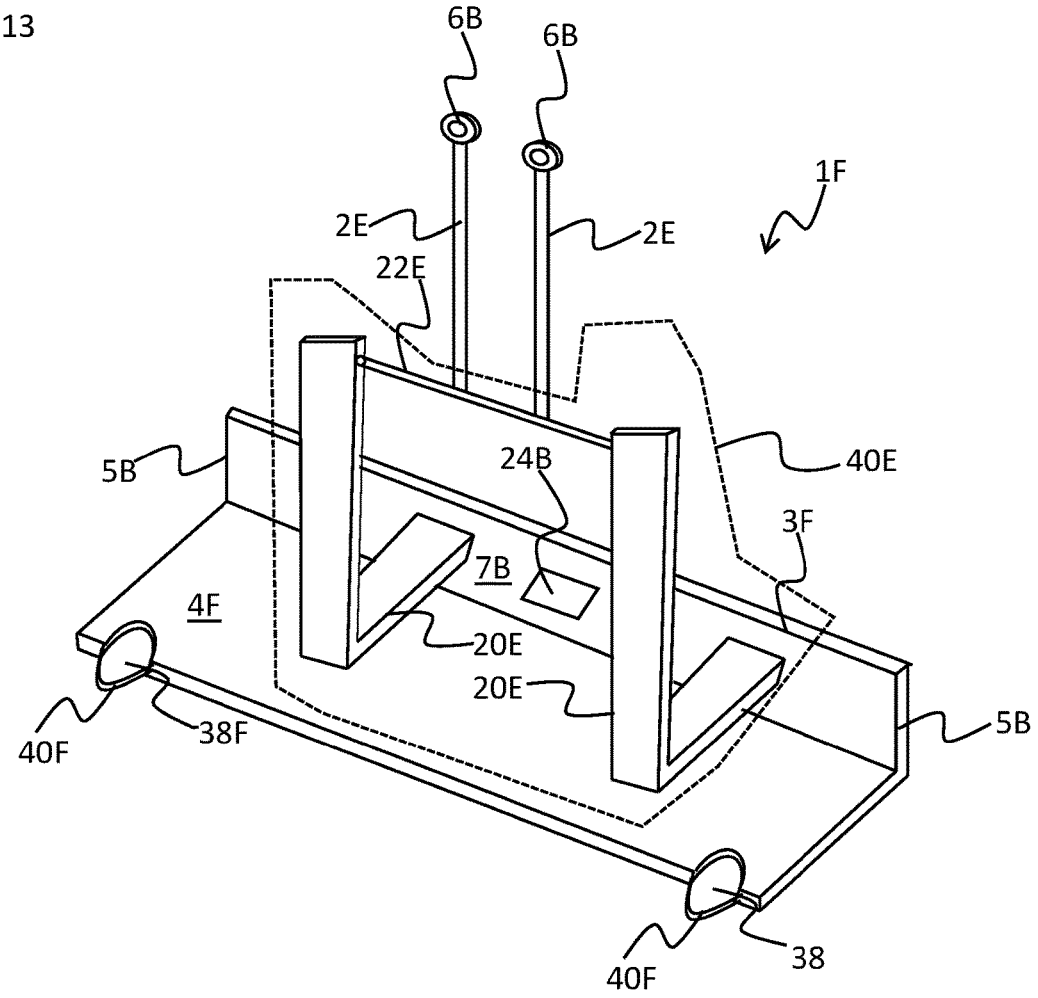
FIG. 13 is a perspective view of another alternative configuration of the third exemplary embodiment of the bed exercise apparatus according to the present invention.
Figure 14:
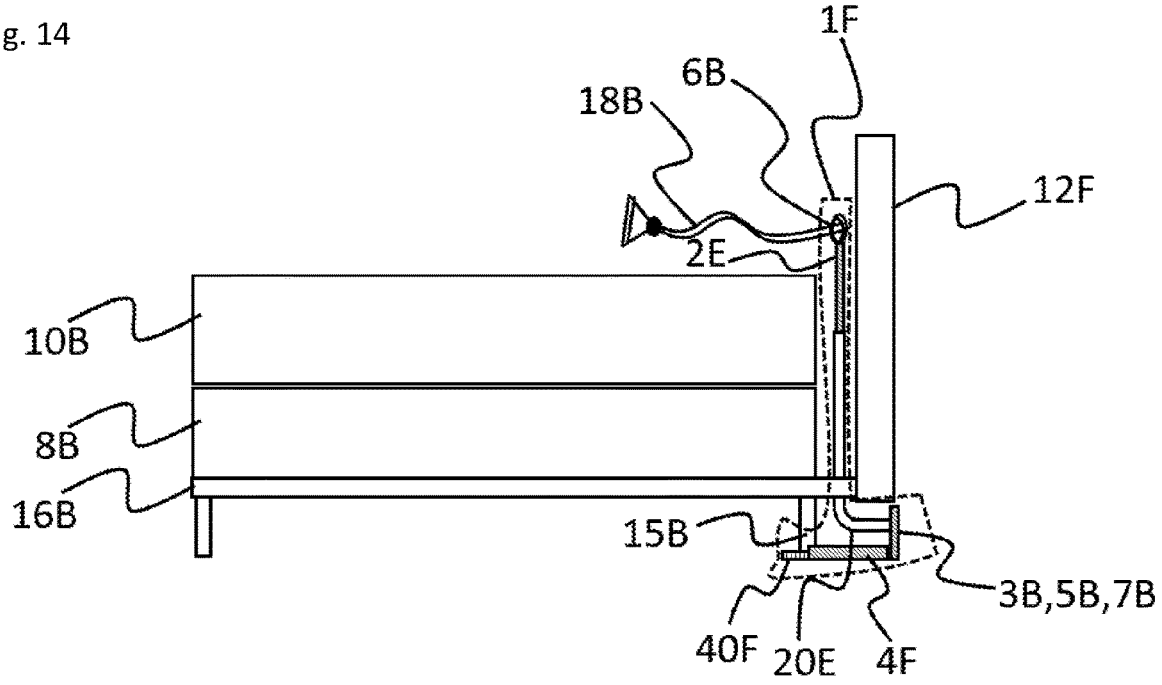
FIG. 14 is a side view of the alternative configuration of the third exemplary embodiment of the bed exercise apparatus shown in FIG. 13 in an exemplary configuration with a headboard, bed frame, box spring and mattress according to the present invention.

FIG. 13 shows an exercise apparatus 1F that is an alternative configuration of the exercise apparatus 1E. Elements of exercise apparatus 1F that are not modified from the exemplary embodiment exercise apparatus 1E have the same element number designations. Exercise apparatus 1F has a base 3F with a single unified pad 4F extending widthwise to the base ends 5B. FIG. 14 is a side view of an exemplary arrangement of the bed exercise apparatus 1F with a headboard 12F, the mattress frame 16B, the box spring 8B and the mattress 10B. The headboard 12F has no legs, in contrast to the headboard 12B, but rather depends upon its attachment to the mattress frame 16B for support; however, a headboard with legs like the headboard 12B may also be used with exercise apparatus 1F. The unified pad 4F extends lengthwise from the vertical base portion 7B a sufficient distance toward the mattress frame 16B such that pad cutouts 38F may partially circumscribe mattress frame legs 15B. Completing the circumscription of the legs of the mattress frame 16B are stays 40F. Alternatively, the single unified pad 4F may not have pad cutouts 38F and the mattress frame legs 15B rest upon the single unified pad 4F. Additionally, the single unified pad 4F may, alternatively, be split into two pads like pads 4B.

Figure 7:
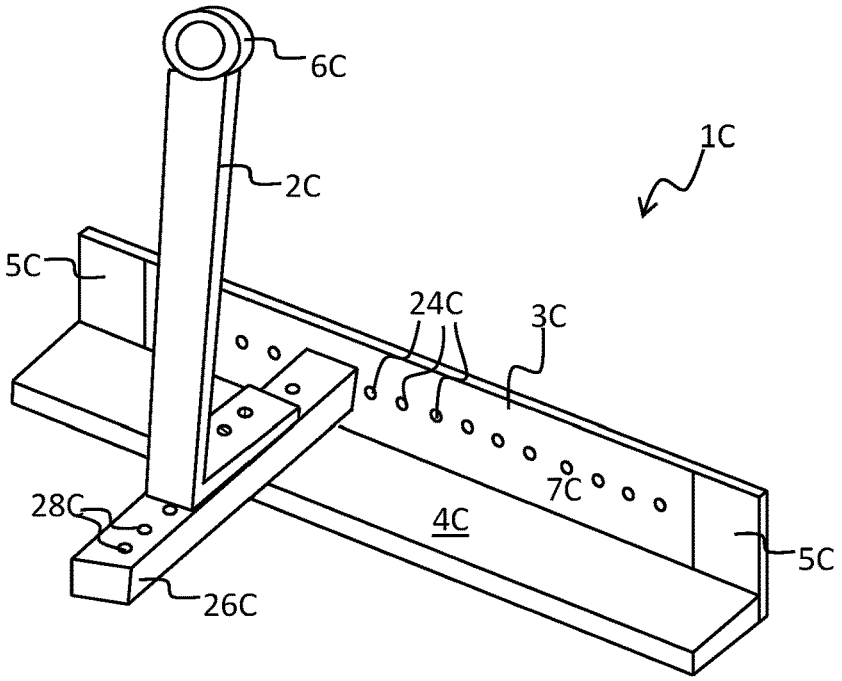
FIG. 7 is a perspective of a fourth exemplary embodiment of the bed exercise apparatus according to the present invention.

FIG. 7 is a perspective view of a fourth exemplary embodiment bed exercise apparatus 1C according to the present invention. The bed exercise apparatus 1C is largely comparable to the bed exercise apparatus 1B. However, rod 2C attaches to a connector 26C rather than to a base 3C. The connector 26C attaches to the base 3C via one of apertures 24C on a vertical base portion 7C. The connector 26C does not extend its entire cross-section through the aperture 24C, instead, a narrowed portion at an end of the connector 26C may extend like a peg through the aperture 24C. Alternatively, a screw or other fastener may be used to attach the connector 26C to the base 3C.

The vertical base portion 7C extends in a widthwise direction between base ends 5C. The vertical base portion 7C may have one or multiple apertures 24C, as in the exemplary embodiment bed exercise apparatus 1C, to allow for adjustment of the position of the rod 2C in the widthwise direction or to allow for multiple rods 2C to be connected to the base 3C at the same time.

Figure 8:
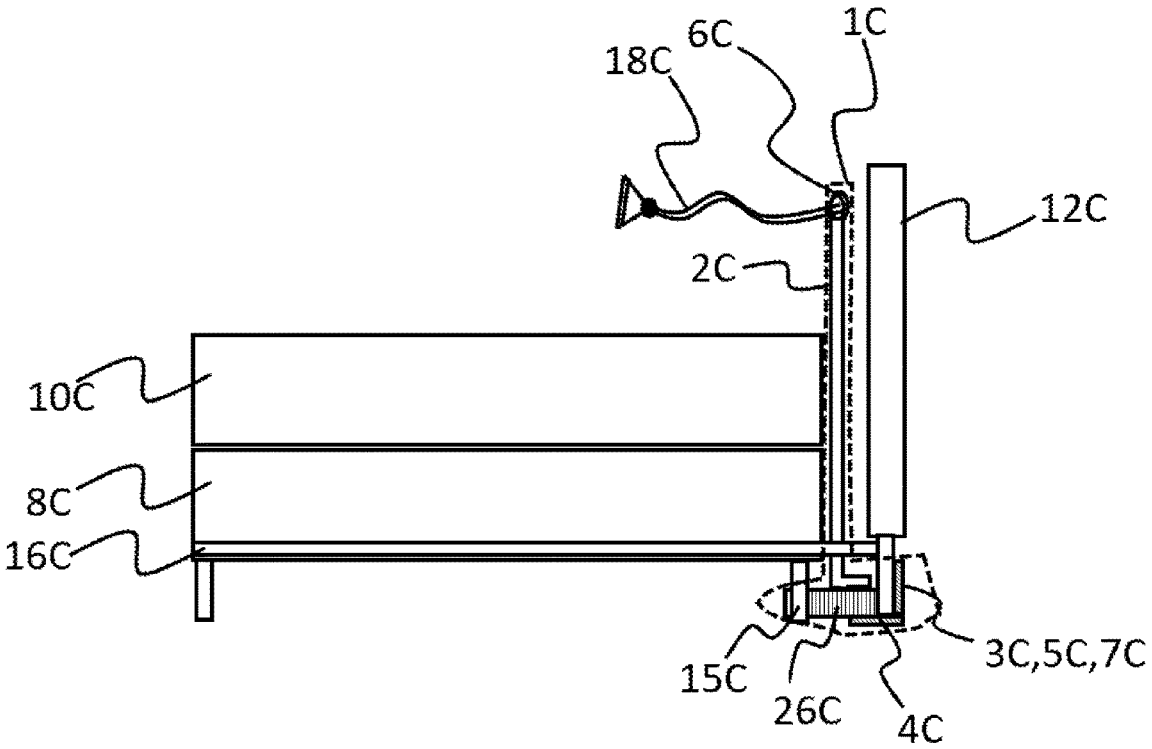
FIG. 8 is a side view of the fourth exemplary embodiment of the bed exercise apparatus with a headboard, bed frame, box spring and mattress according to the present invention.

FIG. 8 is a side view of the bed exercise apparatus 1C in an exemplary arrangement of the bed exercise apparatus 1C with a headboard 12C, mattress frame 16C, box spring 8C and mattress 10C. A pad 4C extends in a widthwise direction between base ends 5C and in a lengthwise direction from the vertical base portion 7C toward the headboard 12C, as shown in FIG. 8, to allow feet 13C of the headboard 12C and the connector 26C to rest upon the pad 4C. Alternatively, the pad 4C may extend further to allow mattress frame feet 15C to rest upon the pad 4C. In the exemplary arrangement shown in FIG. 8, the headboard 12C is between the vertical base portion 7C and the mattress frame 16C. Alternatively, the vertical base portion 7C may be between the headboard 12C and the mattress frame 16C in which case the feet 13C of the headboard 12C will not rest upon the pad 4C.

In the bed exercise apparatus 1C, the pad 4C is an integrated part of the base 3C. In an alternative configuration, the pad 4C may be slidably engaged with the base 3C to provide the capability of adjustment in the lengthwise direction. In another alternative configuration of the bed exercise apparatus 1C, the base 3C may extend at angles to the widthwise and the lengthwise directions rather than distinctly in the widthwise or the lengthwise direction, as shown in FIG. 7, or may extend as a combination of extensions in the widthwise or the lengthwise direction or angles thereof.

The connector 26C extends from the base 3C in the lengthwise direction under the headboard 12C and between the feet 13C of the headboard 12C. The rod 2C attaches to the connector 26C via connector apertures 28C on the connector 26C. The rod 2C angles up from the connector 26C in a vertical direction through a gap where the headboard 12C attaches to the mattress frame 16C and extends above a height of the mattress 10C. At a top of the rod 2C is a ring 6C for attachment of an elastic exercise band 18C and other exercise accessories. Other attachment configurations other than the ring 6C may be implemented for attachment of exercise accessories. The rod 2C may be configured with a telescoping structure so that its height may be adjusted and possibly to allow for the rod 2C to retract below the height of the mattress 10C into a recessed position. This telescoping structure of rod 2C may include a configuration where the parts of the rod 2C are connected to each other via extended helical threading to allow for variation in height by rotating one portion of the rod 2C with respect to another. Alternatively, the rod 2C or the connector 26C may also be rotatable and or removeable.

In one alternative configuration of the exercise apparatus 1C, a horizontal and vertical support structure, comparable to the one disclosed above by the exercise apparatus 1A, may be inserted between one or more of the connectors 26C and one or more rods 2C. Thus, one or more vertical supports, comparable to the vertical supports 20A, may connect to the base 3C and a horizontal support, comparable to the horizontal support 22A, would connect to an upper end or ends on the one or more vertical supports. The one or more rods 2C may then be connected to the horizontal support in any of the ways described above by rod 2A in exercise apparatus 1A.

Figure 9:
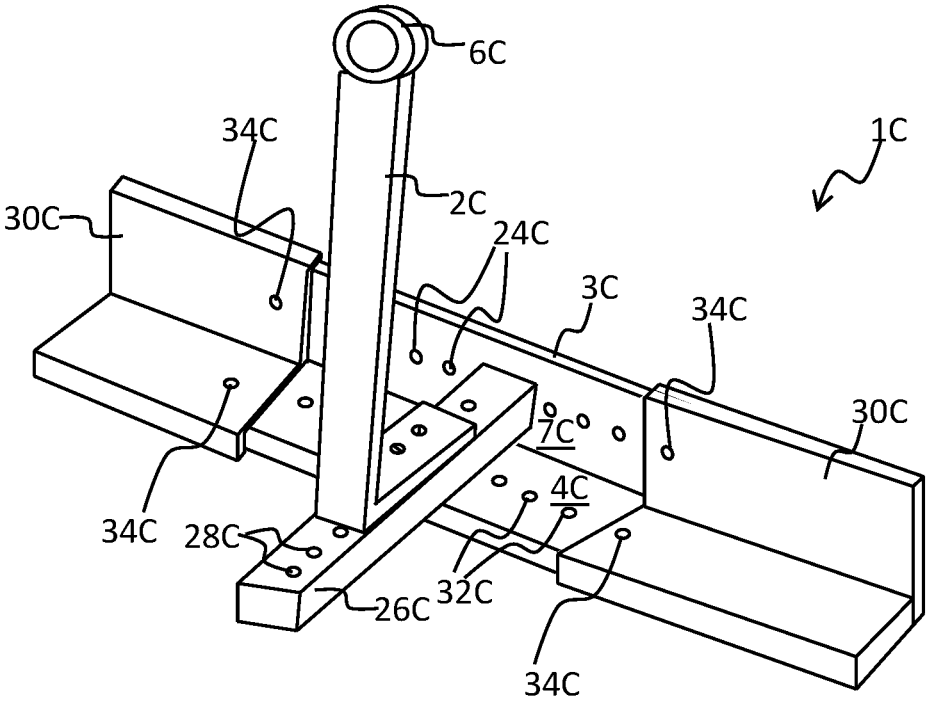
FIG. 9 is a perspective of an alternative configuration of the fourth exemplary embodiment of the bed exercise apparatus according to the present invention.

FIG. 9 shows a perspective view of an alternative configuration of the exercise apparatus 1C. Extenders 30C are slidably engaged with the base 3C. In this embodiment the feet 13C of the headboard 12C rest upon the extenders 30C instead of the pad 4C. The extenders 30C have extender apertures 34C. The extenders 30C may be fastened to the base 3C with a fastener extending through one of the extender apertures 34C and a corresponding one of the apertures 24C on the vertical base portion 7C. Pad apertures 32C are provided and the extender may alternatively or additionally be fastened to the base 3C with a fastener extending through one of the extender apertures 34C and a corresponding one of the pad apertures 32C. The connector 26C may also be fastened to the pad via one of the pad apertures 32C. In another alternative configuration, the exercise apparatus 1C may be provided with one extender 30C slidably engaged with one side of the base 3C. In such an embodiment, one of the feet 13*c* of the headboard 12C will rest on the extender and the other on the pad 4C.

Figure 10:
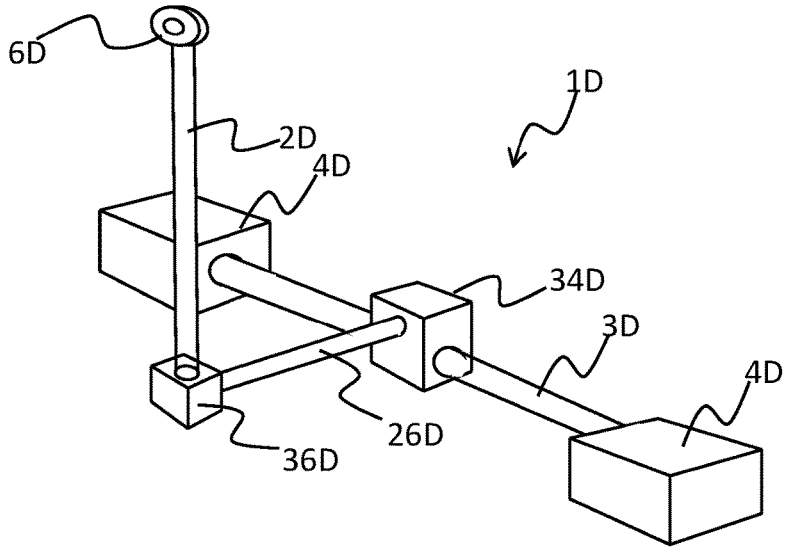
FIG. 10 is a perspective view of a fifth exemplary embodiment of the bed exercise apparatus according to the present invention.
Figure 11:
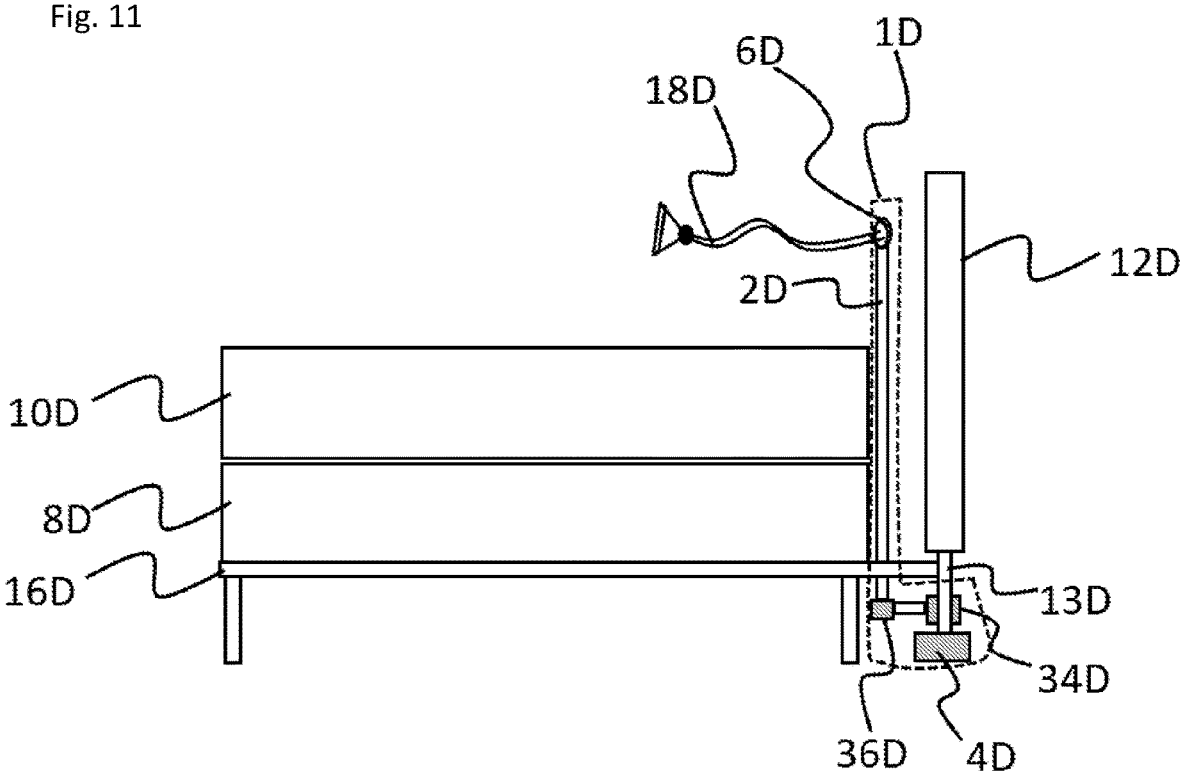
FIG. 11 is a side view of the fifth exemplary embodiment of the bed exercise apparatus with a headboard, bed frame, box spring and mattress according to the present invention.

FIG. 10 is a perspective view of a fifth exemplary embodiment bed exercise apparatus 1D according to the present invention. FIG. 11 is a side view of the bed exercise apparatus 1D in an exemplary arrangement of the bed exercise apparatus 1D with a headboard 12D, mattress frame 16D, box spring 8D and mattress 10D. A base 3D extends in a widthwise direction between pads 4D. Feet 13D of the headboard 12D rest upon the pads 4D. Slidably attached to the base 3D is a base-connector junction 34D whose position may be varied in the widthwise direction. Extending in a lengthwise direction from the base 3D toward the mattress frame 16D is a connector 26D. The connector 26D may be slidably attached at a first end of the connector 26D to the base-connector junction 34D to allow for position adjustment of the connector 26D in the lengthwise direction. At a second end of the connector 26D, distal to the base 3D, is a rod-connector junction 36D. A rod 2D extends from the rod-connector junction 36D in a vertical direction through a gap where the headboard 12D attaches to the mattress frame 16D. The rod 2D is preferably configured to extend above a height of the mattress 10D. The rod 2D may be slidably attached at a first end of the rod 2D to the rod-connector junction 36D to allow for adjustment in the vertical direction. At a top of the rod 2D is a ring 6D for attachment of elastic exercise bands 18D and other exercise accessories. Other attachment configurations other than the rings 6D may be implemented for attachment of exercise accessories. The rod 2D may be configured with a telescoping structure so that their height may be adjusted and possibly to allow for the rod 2D to retract below the height of the mattress 10D so that it is in a recessed position. The telescoping structure of rod 2D may include a configuration where the parts of the rod 2D are connected to each other via extended helical threading to allow for variation in height by rotating one portion of the rod 2D with respect to another. The rod 2D may also be removably and/or rotatably attached to the rod-connector junction 36D. Alternatively, In addition, the rod-connector junction 36D may be removably and/or rotatably attached to the connector 26D.

Figure 15:
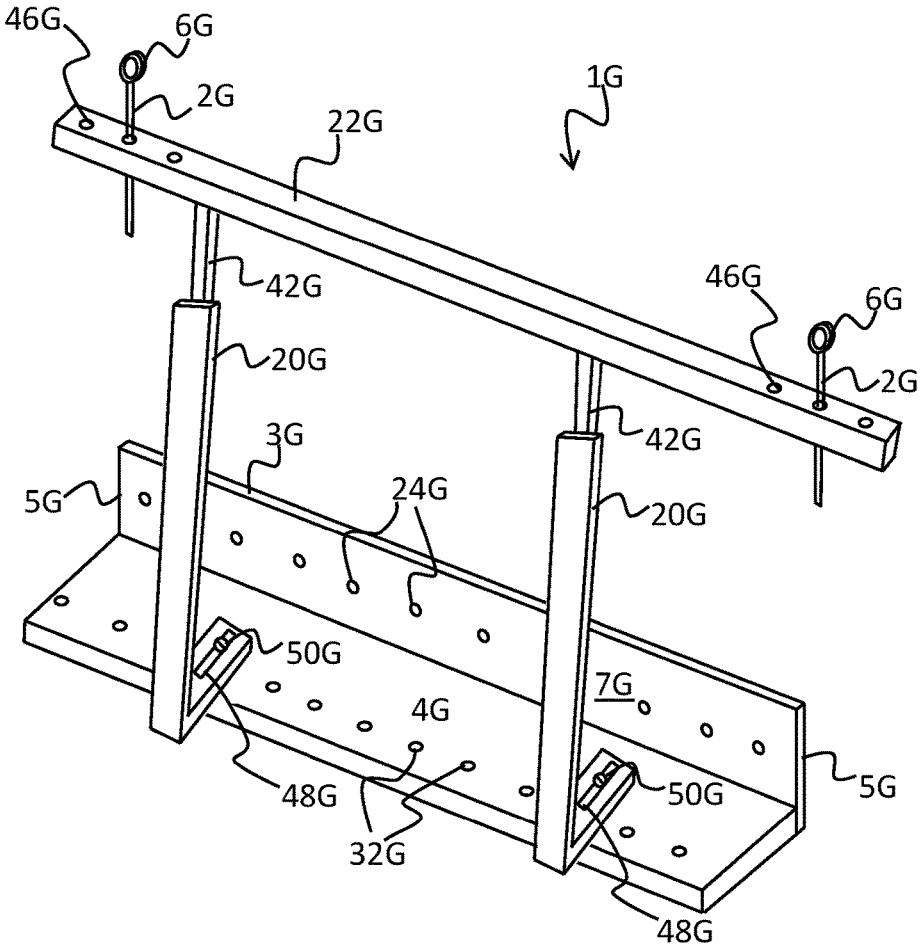
FIG. 15 is a perspective view of a sixth exemplary embodiment of the bed exercise apparatus according to the present invention.
Figure 16:
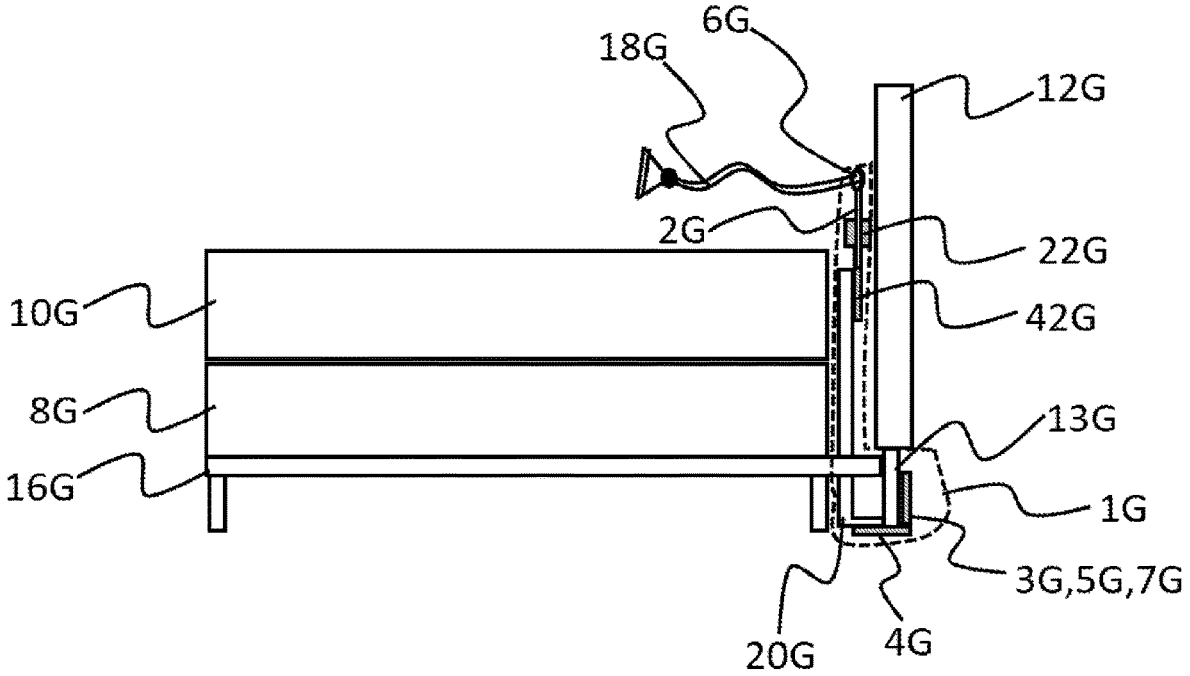
FIG. 16 is a side view of the sixth exemplary embodiment of the bed exercise apparatus with a headboard, bed frame, box spring and mattress according to the present invention.

FIG. 15 is a perspective view of a sixth exemplary embodiment bed exercise apparatus 1G according to the present invention. FIG. 16 is a side view of the bed exercise apparatus 1G in an exemplary arrangement of the bed exercise apparatus 1G with a headboard 12G, mattress frame 16G, box spring 8G and mattress 10G. Rods 2G connect to a horizontal support 22G via horizontal-support apertures 46G. At a top of the rods 2G are rings 6G for attachment of elastic exercise hands 18G and other exercise accessories. Other attachment configurations other than the rings 6G may be implemented for attachment of exercise accessories. The rods 2G may be height adjustable with respect to the horizontal support 22G in a manner described by other exemplary embodiments.

The horizontal support 22G slidably attaches to the vertical supports 20G via horizontal-support legs 42G. Preferably, the horizontal support 22G and/or the rods 2G should be capable of being alternatively positioned between a first position above a height of the mattress 10G and a recessed position below a height of the mattress 10G. The vertical supports 20G extend in a vertical direction from the horizontal-support legs 42G through a gap where the headboard 12G attaches to the mattress frame 16G to a pad 4G of a base 3G. As illustrated in FIGS. 15 and 16 a lower portion of the vertical supports 20G, proximal to the pad 4G, angles in a horizontal lengthwise direction toward a vertical base portion 7G. Alternatively, the vertical supports 20G may be turned around so that the lower portion of the vertical supports 20G angle in the horizontal lengthwise direction away from the vertical base portion 7G. The vertical base portion has vertical base portion apertures 24G.

Each of the vertical supports 20G has a slot 48G through which vertical-support fastener 50G extends. The vertical-support fasteners 50G further extend through pad apertures 32G providing a slidable connection between the vertical supports 20G and the pad 4G allowing for slidable adjustment in the lengthwise direction. The pad 4G extends widthwise between base ends 5G. The pad 4G extends lengthwise from a vertical base portion 7G toward the mattress frame 16G. Feet 13G of the headboard 12G rest on the pad 4G, preferably immediately adjacent to and against the vertical base portion 7G.

Figure 17:
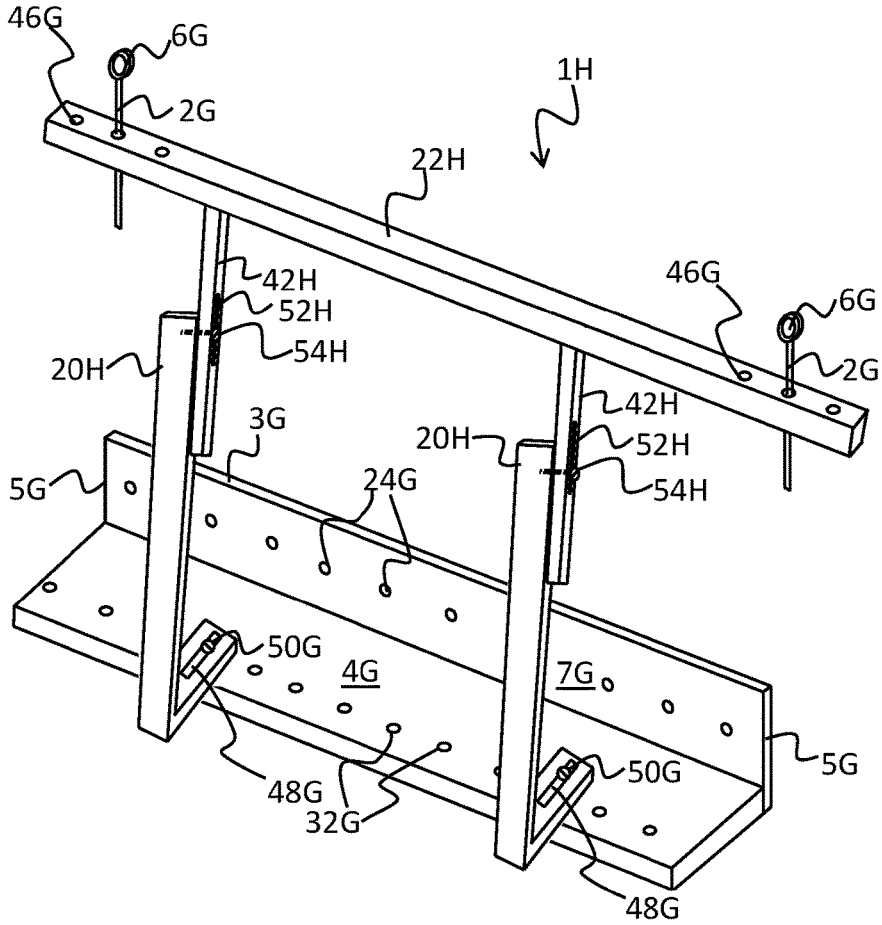
FIG. 17 is a perspective view of an alternative configuration of the sixth exemplary embodiment of the bed exercise apparatus according to the present invention.
Figure 18:
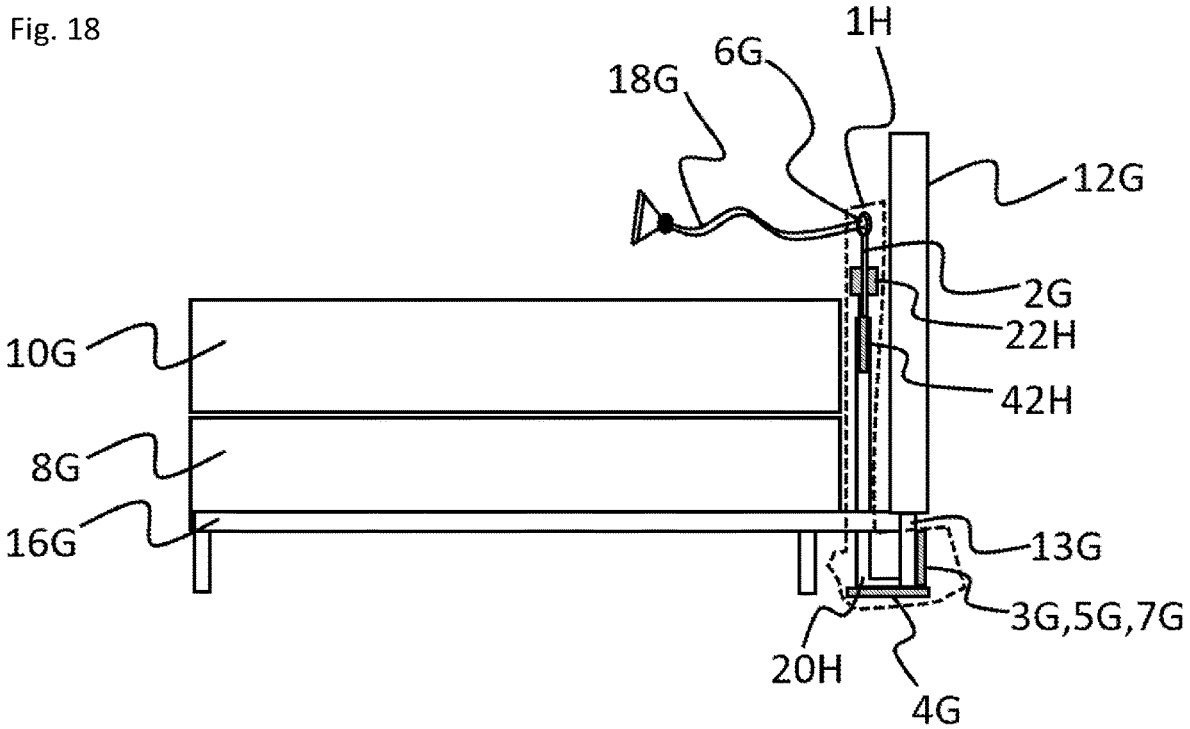
FIG. 18 is a side view of the alternative configuration of the sixth exemplary embodiment of the bed exercise apparatus shown in FIG. 17 with a headboard, bed frame, box spring and mattress according to the present invention.

FIGS. 17 and 18 show an exercise apparatus 1H that is an alternative configuration of the exercise apparatus 1G. Elements of exercise apparatus 1H that are not modified from the exercise apparatus 1G have the same element number designations. In exercise apparatus 1G, the horizontal-support legs 42G of horizontal support 22G attach to sides of the vertical supports 20G that are directly vertically above the lower portion of the vertical supports 20G that angles in a horizontal lengthwise direction. In contrast, in exercise apparatus 1H, the horizontal-support legs 42H of horizontal support 22H attach to sides of the vertical supports 20H that are adjacent to the side that is directly vertically above the lower portion of the vertical supports 20H that angles in a horizontal lengthwise direction. The horizontal-support legs 42H have support-leg slots 52H and fasteners 54H extend through the slot and into the vertical supports 20H to provide a height adjustable connection.

Figure 19:
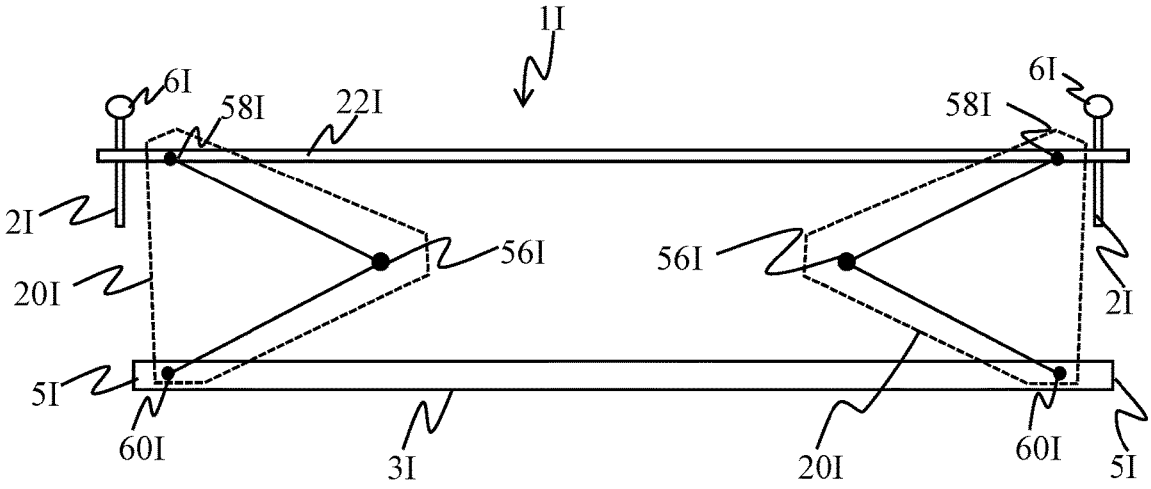
FIG. 19 is a side view of a broad side of a seventh exemplary embodiment of a bed exercise apparatus according to the present invention in a first retracted position.
Figure 20:
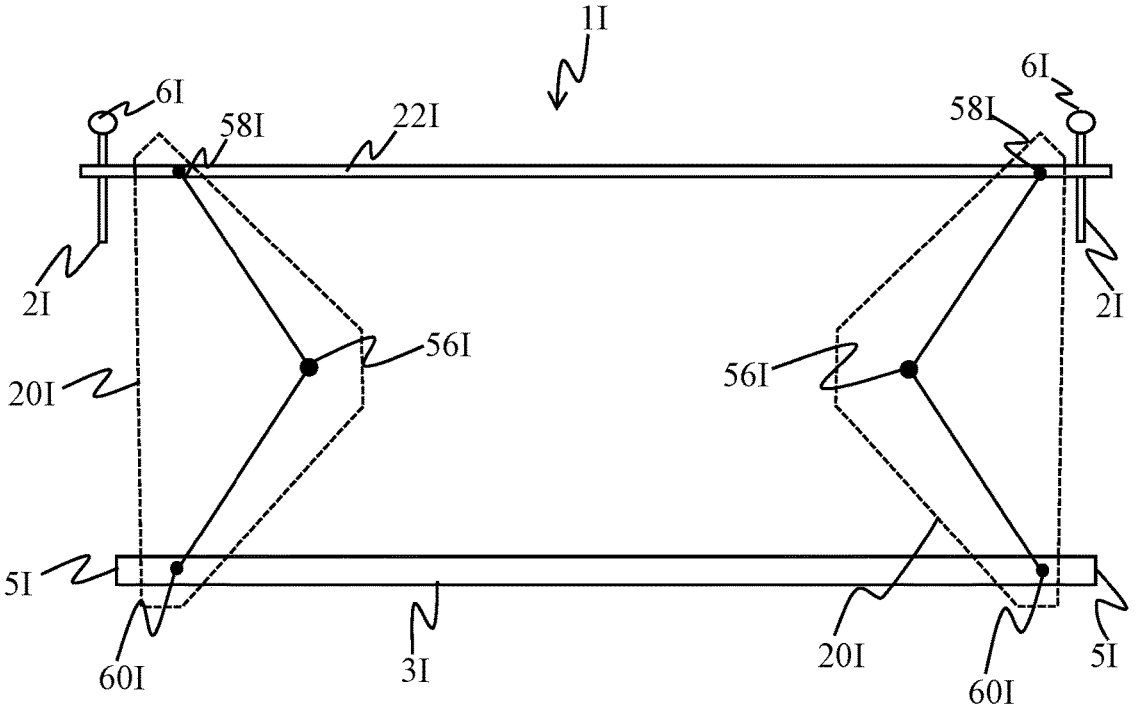
FIG. 20 is a side view of a broad side of the seventh exemplary embodiment in a second extended position.

FIGS. 19 and 20 illustrate a seventh exemplary embodiment of a bed exercise apparatus 1I according to the present invention, FIG. 19 shows a side view of a broad side of the bed exercise apparatus 1I; the broad side being the one that abuts a headboard or its opposing side that abuts a mattress frame, a box spring and a mattress. The bed exercise apparatus 1I has a base 3I that may be configured in a manner comparable to any of the bases in the exemplary embodiments described above. Vertical supports 20I are rotatably attached to the base 3I proximal to base ends 5I via base hinges 60I. At a point along a length of the vertical supports 20I are support hinges 56I. Top ends of the vertical supports 20I are rotatably attached to a horizontal support 22I via top hinges 58I. Attached to the horizontal support 22I are rods 2I with rings 6I for attachment of exercise accessories. The base hinges 60I, support hinges 56I and top hinges 58I are configured so that they may lock at various rotation angles so that the vertical supports 20I may stably support the horizontal support 22I at various heights. In FIG. 19, the base hinges 60I, support hinges 56I and top hinges 58I are at a first rotation angle such that the horizontal support 22I is at a height that the rods 2I are below a height of the mattress, in a system with a headboard, bed frame, box spring and mattress comparable to those discussed above; the bed exercise apparatus 1I thereby being in a first or retracted position. In FIG. 20, the base hinges 60I, support hinges 56I and top hinges 58I are at a second rotation angle such that the horizontal support 22I is at a height that the rods 2I are above a height of the mattress; the bed exercise apparatus 1I thereby being in a second or extended position. A user may thereby adjust the height between the retracted position when not using of the bed exercise apparatus 1I and the extended position when using the bed exercise apparatus 1I. The attachment configuration of the rods 2I to the horizontal support 22I as well as the configuration of the rods 2I themselves may be in any manner comparable to what is described in the exemplary embodiments described above.

Figure 21:
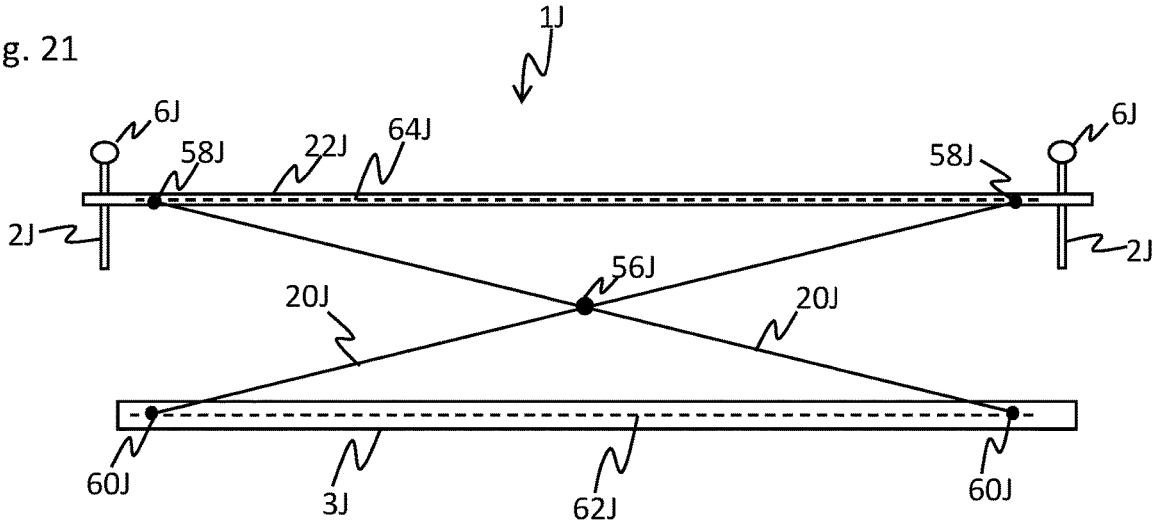
FIG. 21 is a side view of a broad side of an eighth exemplary embodiment of a bed exercise apparatus according to the present invention in a first retracted position.
Figure 22:
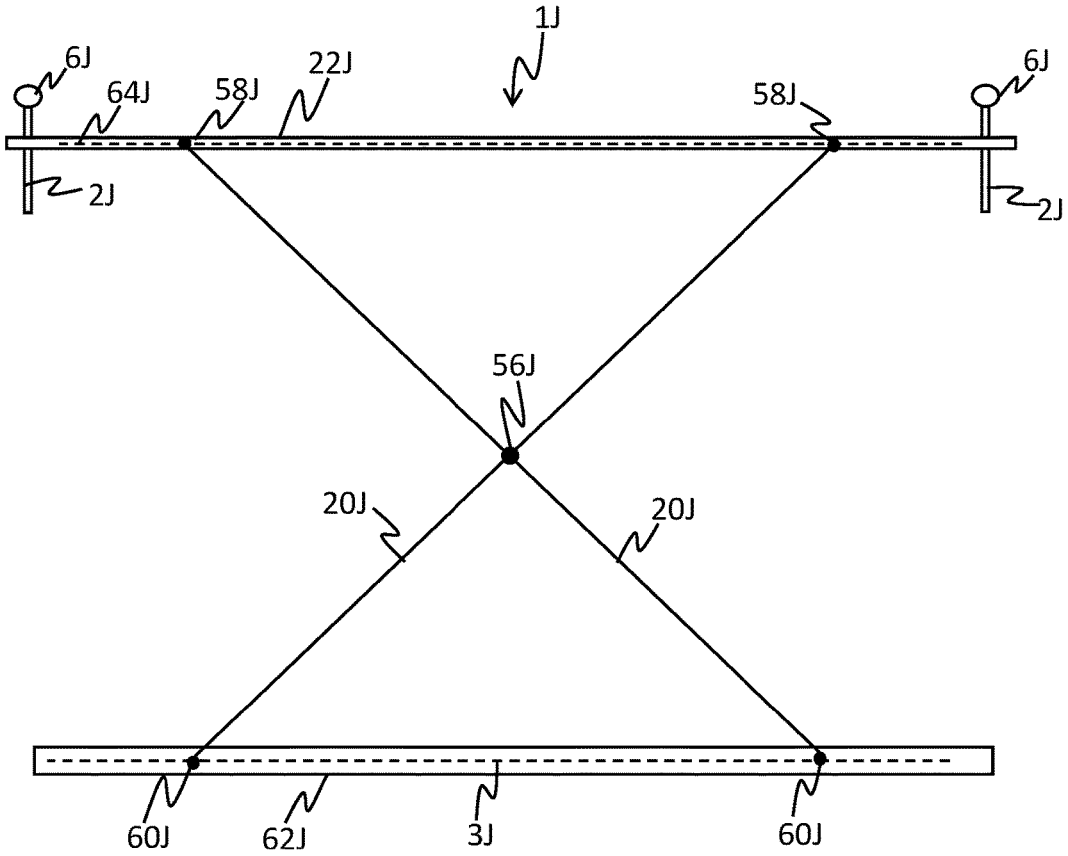
FIG. 22 is a side view of a broad side of the eighth exemplary embodiment in a second extended position.

FIGS. 21 and 22 illustrate an eighth exemplary embodiment of a bed exercise apparatus 1J according to the present invention. FIG. 21 shows a side view of a broad side of the bed exercise apparatus 1J; the broad side being the one that abuts a headboard or its opposing side that abuts a mattress frame, a box spring and a mattress. The bed exercise apparatus 1J has a base 3J that may be configured in a manner comparable to any of the bases in the exemplary embodiments described above. Vertical supports 20J are slidably attached at vertical support base ends 60I to the base 3J via a base guideway 62J. At a point along a length of the vertical supports 20J, the vertical supports 20J are rotatably attached via support hinge 56J. Vertical support top ends 58J are slidably attached to a horizontal support 22J via a horizontal support guideway 64J. Attached to the horizontal support 22J are rods 2J with rings 6J for attachment of exercise accessories. The base guideway 62J and the vertical support base ends 60J are configured so that the vertical support base ends 60J may lock in place at various positions along the base guideway 62J. Similarly, the horizontal support guideway 64J and the vertical support top ends 58J are configured so that the vertical support top ends 58J may lock in place at various positions along the horizontal support guideway 64J. This allows the vertical supports 20J to stably support the horizontal support 22J at various heights. In FIG. 21, the vertical support base ends 60J are locked in place at first base-positions along the base guideway 62J and the vertical support top ends 58J are locked in place at first horizontal support-positions along the horizontal support guideway 64J such that the horizontal support 22J is at a height that the rods 2J are below a height of the mattress, in a system with a headboard, bed frame, box spring and mattress comparable to those discussed above; the bed exercise apparatus 1J thereby being in a first or retracted position. In FIG. 22, the vertical support base ends 60J are locked in place at second base-positions along the base guideway 62J and the vertical support top ends 58J are locked in place at second horizontal support-positions along the horizontal support guideway 64J such that the horizontal support 22J is at a height that the rods 2J are above a height of the mattress; the bed exercise apparatus 1J thereby being in a second or extended position. A user may thereby adjust the height of the horizontal support 22J between the retracted position when not using the bed exercise apparatus 1J and the extended position when using the bed exercise apparatus 1J. The attachment configuration of the rods 2J to the horizontal support 22J as well as the configuration of the rods 2J themselves may be in any manner comparable to what is described in the exemplary embodiments described above.

In an alternative configuration of the bed exercise apparatus 1J the vertical supports 20J, instead of being slidably attached to the horizontal support 22J and the base 3J, are selectively-fixed in place. Apertures may be provided on the base 3J at the first base-positions and second base-positions as well as various other positions where the vertical supports 20J may be fastened. Similarly, the horizontal support 22J may have apertures at the first horizontal support-positions and second horizontal support-positions as well as various other positions where the vertical supports 20J may be fastened. When the vertical support top ends 58J are selectively-fixed in place to the horizontal support 22J at the first horizontal support-positions and the vertical support base ends 60J are selectively-fixed in place to the base 3J at the first base-positions, then the bed exercise apparatus 1J will be in the first or retracted position. When the vertical support top ends 58J are selectively-fixed in place to the horizontal support 22J at the second horizontal support-positions and the vertical support base ends 60J are selectively-fixed in place to the base 3J at the second base-positions, then the bed exercise apparatus 1J will be in the second or extended position. A user may thereby adjust the height of the horizontal support 22J between the retracted position when not using the bed exercise apparatus 1J and the extended position when using the bed exercise apparatus 1J.

The embodiments of the invention described herein are exemplary in nature, and therefore, the spirit and the scope of the invention are by no means restricted to what is described above or intended to represent every possible embodiment of the invention. For example, the terms vertical and horizontal are not limited to a strictly vertical or horizontal direction, i.e. perpendicular and parallel, respectively, with respect to the floor or bed, but rather can include other angles so long as functionality is provided. The bases in the exemplary embodiments may be split into two separate pieces that are completely unattached and may possibly not even abut each other. The bed exercise apparatus embodiments as described herein may also be implemented in an arrangement without the box spring.

What is claimed is:

1. A bed exercise apparatus comprising:

a. a bed frame;

b. a mattress on the bed frame;

c. a headboard positioned by a head of the bed frame;

d. a base positioned proximal to the head of the bed frame;

e. a rod directly or indirectly connected to the base; and f. a pad connected to the base, wherein the rod extends above a top surface of the mattress, the rod or the rod's connection to the base extends through a space between the mattress and the headboard, and the base is held in place by a leg of the headboard or a leg of the bed frame resting on the pad.

2. The bed exercise apparatus of claim 1 wherein the pad is slidably connected to the base.

3. The bed exercise apparatus of claim 1 wherein the rod is slidably connected to the base.

4. The bed exercise apparatus of claim 1 wherein the rod is movably connected in a widthwise and/or a lengthwise direction with respect to the base.

5. A bed exercise apparatus comprising:

a. a bed frame;

b. a mattress on the bed frame;

c. a headboard positioned by a head of the bed frame;

d. a base positioned proximal to the head of the bed frame;

e. a pad connected to the base and held in place by a leg of the headboard or a leg of the bed frame; and f. a rod with an exercise attachment coupler, wherein the rod is connected to the base and extends from the base via a space between the mattress and the headboard above a top surface of the mattress.

6. A bed exercise comprising:

a. a bed frame;

b. a mattress on the bed frame;

c. a headboard positioned by a head of the bed frame;

d. a base positioned proximal to the head of the bed frame;

e. a pad connected to the base and held in place by a leg of the headboard or a leg of the bed frame;

f. a support connected to the base and extending from the base to and/or through a space between the mattress and the headboard; and g. a rod with an exercise attachment coupler connected to the support and extending from the support above a top surface of the mattress.

7. The bed exercise apparatus of claim 6, wherein the support is a structure comprised of:

a. a first or vertical support connected to the base that extends from the base to and/or through a space between the mattress and the headboard.

8. The bed exercise apparatus of claim 7, wherein the structure is further comprised of:

a. a second or horizontal support connected to the first or vertical support that extends in a widthwise direction, wherein the rod is connected to the second or horizontal support.

* * * * *